US005266129A

United States Patent [19]

Minakuchi et al.

[11] Patent Number: 5,266,129

[45] Date of Patent: Nov. 30, 1993

[54] PROCESS FOR PRODUCTION OF ORIENTED ELECTRICAL STEEL SHEET HAVING EXCELLENT MAGNETIC PROPERTIES

[75] Inventors: Masayoshi Minakuchi; Yasumitsu Kondo; Maremizu Ishibashi, all of Kitakyushu, Japan

[73] Assignee: Nippon Steel Corporation, Tokyo, Japan

[21] Appl. No.: 948,361

[22] Filed: Sep. 21, 1992

[30] Foreign Application Priority Data

Sep. 26, 1991 [JP] Japan ..... 3-248091

[51] Int. Cl.[5] ..... H01F 1/04

[52] U.S. Cl. ..... 148/113; 148/111

[58] Field of Search ..... 148/111, 112, 113

[56] References Cited

U.S. PATENT DOCUMENTS 5,082,509 1/1992 Ushigami et al. ..... 148/111
5,145,533 9/1992 Yoshitomi et al. ..... 148/111

FOREIGN PATENT DOCUMENTS 0390142 10/1990 European Pat. Off. ..... 148/111
52-24116 2/1977 Japan .
59-56522 4/1984 Japan .
2-200732 8/1990 Japan .
2-267223 11/1990 Japan .

*Primary Examiner*—John P. Sheehan
*Attorney, Agent, or Firm*—Kenyon & Kenyon

[57] ABSTRACT

A slab for an electrical steel sheet is heated at a temperature of 1280° C. or below and then hot-rolled. The hot-rolled steel sheet or hot rolled and annealed steel sheet is then cold-rolled once or at least twice with intermediate annealing being performed between rollings. The cold-rolled sheet is decarburized and nitrided to form an inhibitor. The amount of nitrogen of in the steel sheet during the nitriding treatment subsequent to the decarburization annealing and the iron loss value after the withdrawal of the steel sheet from the furnace are measured to estimate the average diameter of a primary recrystallized grain, and next decarburization annealing is performed under conditions regulated in such a manner that the average diameter of the primary recrystallized grain of a product sheet falls within a proper range. The steel sheet subjected to the decarburization annealing is coated with an annealing separator composed mainly of MgO and then subjected to finish annealing.

6 Claims, 5 Drawing Sheets

PROCESS FOR PRODUCTION OF ORIENTED ELECTRICAL STEEL SHEET HAVING EXCELLENT MAGNETIC PROPERTIES

BACKGROUND OF THE INVENTION

1. Field of the Invention

The present invention relates to a process for production of an oriented electrical steel sheet, and more particularly to an oriented electrical steel sheet having a low iron loss particularly by using a technique for heating a slab at a low temperature.

2. Description of the Prior Art

An oriented electrical steel sheet is used mainly as an iron core material for a transformer, a generator and other electrical equipment and should have excellent magnetic properties, particularly iron loss properties.

An oriented electrical steel sheet is produced by developing a crystal grain having the so-called "Goss orientation", that is, having a (110) face on the rolled surface and an [001] axis in the rolling direction by utilizing a secondary recrystallization phenomenon.

As is well known in the art, secondary recrystallization occurs in finish annealing. In this case, the so-called "inhibitor", which is a fine precipitate of AlN, MnS, MnSe or the like for regulating the growth of a primary recrystallized grain until the temperature reaches a secondary recrystallization region, should be present.

For this reason, an electric steel slab is heated to a high temperature, for example, about 1350° to 1400° C. so as to form an inhibitor, for example, AlN, MnS or MnSe, in a solid solution, and annealing is performed for finely precipitating the inhibitor when the material is in the form of a hot rolled sheet or an intermediate sheet before final cold rolling.

Such a treatment has enabled an oriented electrical steel sheet having a high magnetic flux density to be produced. Since, however, the electrical steel slab is heated at the above-described high temperature, there occurs a large amount of a molten scale, which hinders the operation of a heating furnace. Further, this process has problems in that it requires a high energy unit and it creates surface defects.

For this reason, studies have been made on a process for producing an oriented electrical steel sheet at a lowered slab heating temperature. For example, Japanese Unexamined Patent Publication (Kokai) No. 55-24116 discloses a process wherein a slab is heated at 1100° to 1260° C. through the incorporation of a nitride forming element, such as Zr, Ti, B, Ta, V, Cr or Mo, in addition to Al. Further, Japanese Unexamined Patent Publication (Kokai) No. 59-56522 proposes a process wherein an electrical steel slab having a Mn content of 0.08 to 0.45%, a S content of 0.007%, a lowered content [Mn]×[S] and further comprising Al, P and N is used as the material.

The process wherein the slab is heated at a low temperature exhibits certain functions and effects. In this process, however, since the inhibitor forming ingredient, for example, Al, Mn, S, Se or N, is not completely dissolved in the steel, the formation of an inhibitor useful for the development of a secondary recrystallization is the task of this process.

In Japanese Unexamined Patent Publication (Kokai) No. 2-200732, the applicant for the present invention has proposed a process wherein when an oriented electrical steel sheet cold-rolled to a predetermined sheet thickness is passed in the form of a strip, through a decarburization annealing furnace, and the sheet is nitrided by using $NH_3$ to form an inhibitor in situ.

In a process for producing an oriented electrical steel sheet that comprises nitriding a steel sheet subjected to decarburization annealing by using a gas having a nitriding capability to strengthen the inhibitor, coating the nitrided sheet with an annealing separator composed mainly of MgO, taking up the coated sheet in coil form and subjecting the sheet to finish annealing; the development of the secondary recrystallization varies despite an identical degree of nitriding, which often gives rise to a variation in the magnetic flux density and iron loss or an inferior secondary recrystallized grain called "fine grain".

SUMMARY OF THE INVENTION

An object of the present invention is to provide an oriented electrical steel sheet having a stably developed secondary recrystallized grain and excellent magnetic properties such as iron loss through an annealing method wherein decarburization is followed by nitriding of the steel sheet.

The present inventors have conducted detailed studies on the relationship between the amount of nitrogen and the iron loss value and, as a result, have found that the average diameter of the primary recrystallized grain can be determined by measuring the amount of nitrogen and the iron- loss value of a steel sheet subjected to decarburization annealing and nitriding, that the average diameter of the primary recrystallized grain has a great influence on the iron loss value of a product sheet and there is a clear correlation between the average diameter of the primary recrystallized grain and the iron loss value and that the average diameter of the primary recrystallized grain can be regulated by varying the heating temperature in the decarburization annealing thereby enabling the iron loss value of the product sheet to be regulated, which has led to the completion of the present invention.

Accordingly, the present invention relates to a process for producing an oriented electrical steel sheet, comprising the steps of: heating a slab of an electrical steel sheet to a temperature of 1280° C. or less, hot-rolling the slab, subjecting the hot-rolled sheet before or after annealing to cold rolling once or at least twice with intermediate annealing being performed between rollings, subjecting the cold-rolled sheet to decarburization annealing and nitriding treatment to form an inhibitor in said steel sheet, measuring the amount of nitrogen and the iron loss value of the steel sheet after said treatment to determine the average diameter of a primary recrystallized grain formed during the decarburization annealing, determining the primary recrystallized average grain-diameter corresponding to the iron loss value of a final product sheet with proper range from a relationship between the average diameter of the primary recrystallized grain and the iron loss value of the final product sheet, determining a proper decarburization annealing temperature from a relationship between the average diameter of the primary recrystallized grain and the decarburization annealing temperature to form said primary recrystallized average grain-diameter so that the iron loss value of the final product sheet falls within a proper range, and regulating the heating temperature in the decarburization annealing based on the determined temperature.

After the steel sheet is subjected to decarburization annealing at a temperature regulated in such a manner that the average diameter of the primary recrystallized grain becomes optimal to obtain a desired iron loss value of the final product sheet, it is coated with an annealing separator and then subjected to final annealing.

DESCRIPTION OF THE PREFERRED EMBODIMENTS

At the outset, the present inventors have conducted an examination on the cause of the variation in magnetic properties and, as a result, have found that the average diameter of the primary recrystallized grain varies from charge to charge.

In an oriented electrical steel sheet produced by heating an electrical steel slab at a high temperature, bringing an inhibitor forming ingredient to a solid solution state, and precipitating as an inhibitor MnS, MnSe or AlN+MnS when annealing a hot-rolled sheet or during the intermediate annealing before the final cold rolling, even when decarburization annealing conditions vary, the state of development of secondary recrystallization cannot vary because of the strong action of the inhibitor. On the other hand, it has been found that in a process for producing an oriented electrical steel sheet wherein the inhibitor is strengthened through nitriding prior to the development of the secondary recrystallization, the average diameter of the primary recrystallized grain is greatly influenced by the furnace temperature during decarburization annealing because the inhibitor is weak during the process in which primary recrystallization occurs.

Further, the present inventors have conducted studies on the influence of ingredients in the steel on the average diameter of the primary recrystallized grain and, as a result, have found that the average diameter of the primary recrystallized grain is influenced by the concentration of residual Al (AlR), which is not linked to nitrogen in the steel.

Figure 1:
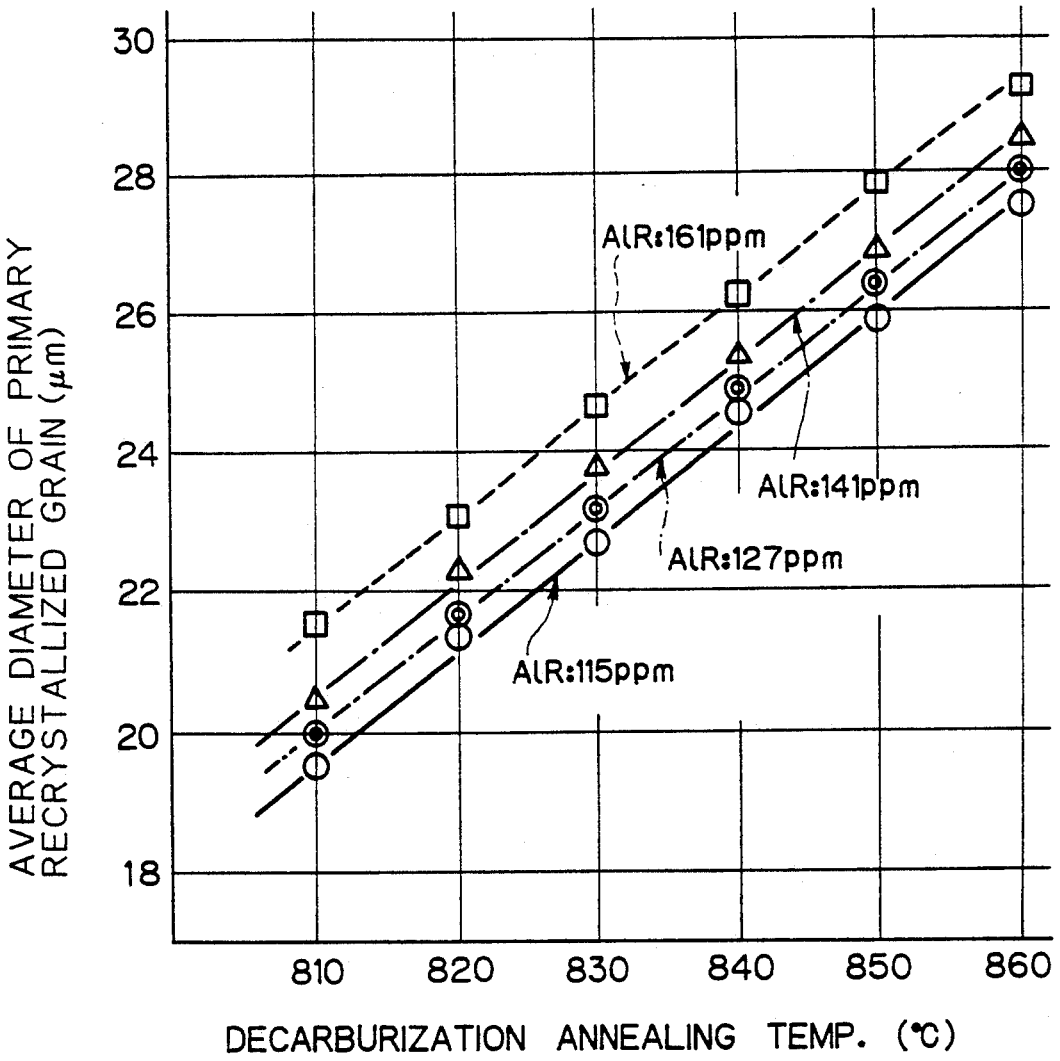
FIG. 1 is a graph showing the relationship between the decarburization annealing temperature and the average diameter of primary recrystallized grain after decarburization annealing.

Specifically, as shown in FIG. 1, the average diameter of the primary recrystallized grain increases with an increase in the decarburization annealing temperature. The larger the amount of AlR, the greater the increase in the average diameter of the primary recrystallized grain. Therefore, it has been found that a desired average diameter of a primary recrystallized grain by determining the amount of AlR can be attained by adjusting the decarburization annealing temperature according to FIG. 1.

The present inventors conducted the following experiment for determining the relationship between the average diameter of primary recrystallized grain after decarburization annealing and the iron loss value.

Product sheets were produced by using a test material of a steel sheet comprising, in terms of % by weight, 0.057% of C, 3.22% of Si, 0.014% of Mn, 0.08% of S, 0.008% of Al (acid soluble Al), 0.0076% of N and further 0.01 to 0.07% of Sn with the decarburization annealing temperature being varied. Further, the $NH_3$ concentration as well was varied in the nitriding treatment subsequent to the decarburization treatment so as to vary the amount of nitrogen of the steel sheet. The image of the primary recrystallized grain of the steel sheet was observed under a microscope, and the average diameter of the primary recrystallized grain was determined by image analysis or the like. Then, the iron value of the steel sheet was measured so as to determine the relationship between the iron loss value and the average diameter value of the primary recrystallized grain.

Figure 2:
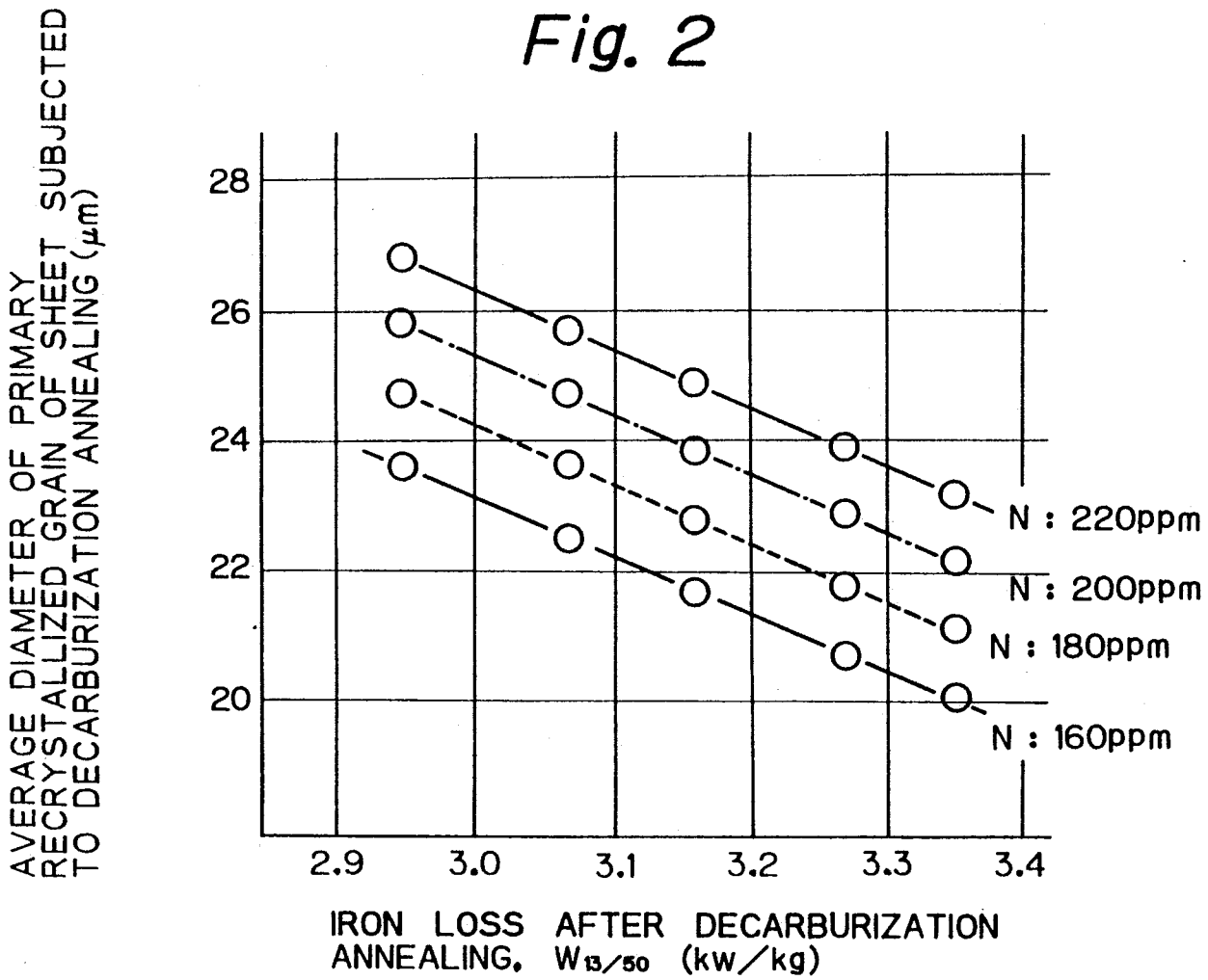
FIG. 2 is a graph showing the relationship between the iron loss value after decarburization annealing and the average diameter of primary recrystallized grain after decarburization annealing.

The results are shown in FIG. 2. As shown in FIG. 2, it was found that when the amount of nitrogen of the steel sheet is taken into consideration, the average diameter of the primary recrystallized grain after decarburization can be estimated by measuring the iron loss value. From this fact, it is apparent that the average grain-diameter, D (μm), can be determined according to the following formula (1) by using the iron loss value after decarburization annealing, W (W/kg), and the amount of nitrogen of the steel sheet, N (ppm).

$$D=0.053\times[N]-9.0\times W+41.71\ \mu m \quad (1)$$

Figure 3:
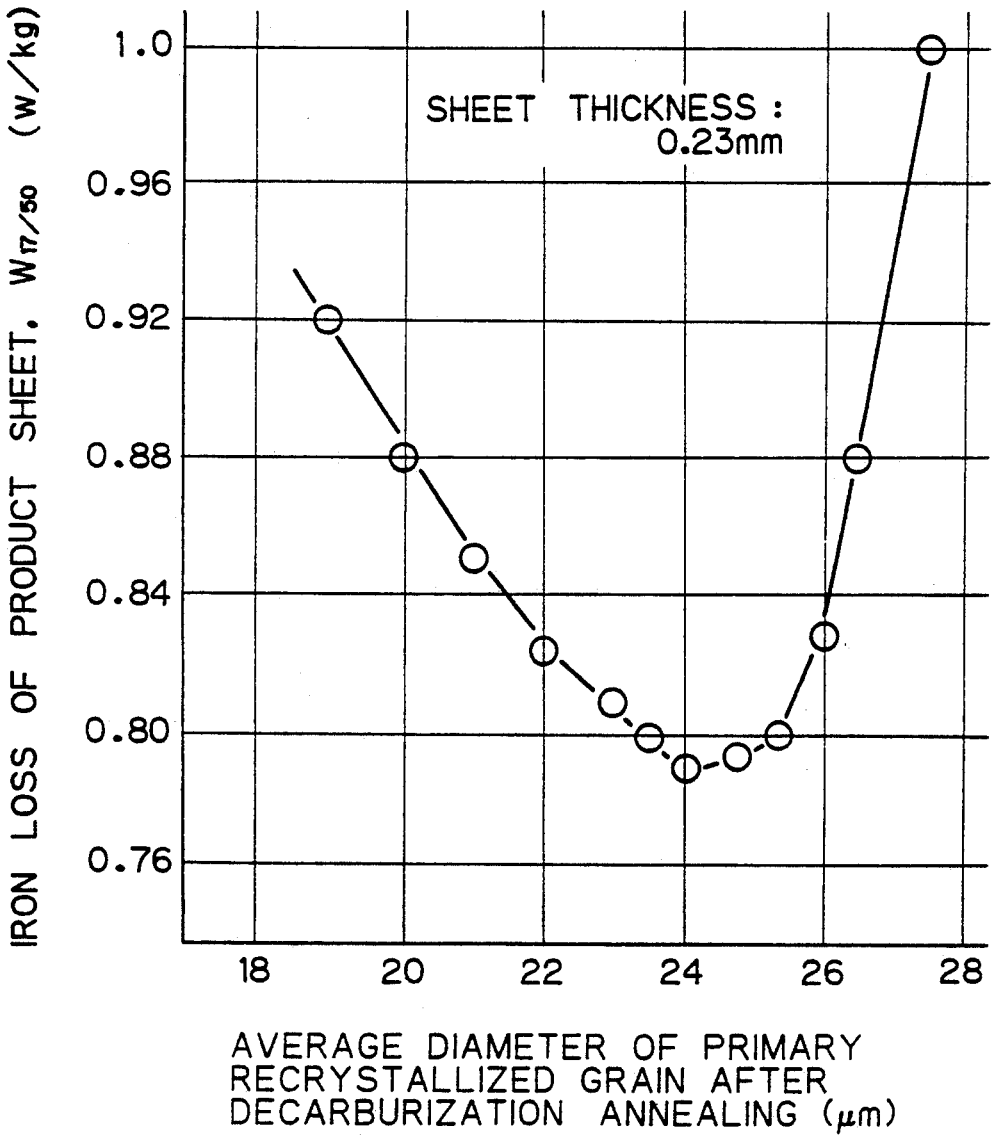
FIG. 3 is a graph showing the relationship between the average diameter of primary recrystallized grain after decarburization and the iron loss value of a product sheet.

The relationship between the iron value of a final product sheet produced by coating the steel sheet with an annealing separator composed mainly of MgO and subjecting the steel sheet to finish annealing and the estimated value of the average diameter of the primary recrystallized grain determined from the amount of nitrogen of the steel sheet and the iron value after decarburization annealing is shown in FIG. 3. As is apparent from FIG. 3, there is a very clear correlation between the average grain-diameter determined from the iron loss value of the sheet subjected to decarburization annealing and the amount of nitrogen of the steel sheet and the iron loss value of the final product sheet. This enables the iron loss value of the final product sheet after finish annealing to be freely regulated by regulating the iron loss value through the steel sheet temperature in the decarburization annealing, so that it becomes possible to produce an oriented electrical steel having a low and uniform iron loss and excellent magnetic properties.

Specifically, FIG. 3 shows that an electrical steel sheet having an iron loss value of 0.82 or less and excellent magnetic properties in the final product sheet can be obtained by regulating the average grain-diameter so as to fall within the range of from 23.5 to 25.5 μm.

As is apparent from the foregoing description, if the average diameter of the primary recrystallized grain can be regulated so as to fall within a proper range, it is possible to eliminate the problem of poor secondary recrystallization and the occurrence of a variation in magnetic properties such as iron loss, which enables an oriented electrical steel sheet having excellent magnetic properties to be produced on a commercial scale.

The present invention will now be described in more detail.

An Al-containing electrical steel slab heated at a temperature of 1280° C. or below is hot-rolled and then optionally annealed. The electrical steel slab is heated at a temperature of 1280° C. or below in order to prevent the occurrence of molten scale and surface defects and to save energy. The sheet is then cold-rolled once or at least twice with intermediate annealing being conducted between the cold rollings to a desired sheet thickness and subjected to decarburization annealing. The above-described cold rolling including one wherein the sheet is heated to about 50° to 300° C. between rolling. The decarburization annealing is conducted by holding the sheet in an atmosphere having a dew point of 60° to 75° C., a $H_2$ content of 75% and a $N_2$ content of 25% at a temperature in the range of from 800° to 880° C. for 110 to 180 sec. The decarburization annealing reduces the carbon content of the steel sheet to, for example, 30 ppm or less and causes an oxide layer containing $SiO_2$ to be formed on the surface of the steel sheet. In this case, the steel sheet is decarburized and, at the same time, gives rise to primary recrystallization.

Subsequently, a nitriding treatment is performed in a nitriding chamber having a partition wall in a decarburization annealing furnace or a nitriding furnace. The nitriding treatment is conducted by introducing a very small amount of $NH_3$ into an atmosphere having a dew point of −30° to +20° C., a $H_2$ content of 75% and a $N_2$ content of 25% and holding the steel sheet in this atmosphere at a temperature in the range of from 700° to 800° C. for 15 to 40 sec.

The amount of nitrogen of the steel sheet thus treated is determined by measuring the amount of nitrogen of a sample obtained after decarburization annealing, and the iron loss value of the steel sheet is determined by a known on-line iron loss measuring method. This iron loss measuring method comprises providing primary and secondary coils for an iron loss measurement either between the annealing furnace and the annealing separator coating device, or between the annealing separator coating device and the coiler for taking up the steel sheet in coil form, and passing the steel sheet through the primary and secondary coils to measure the iron loss.

The degree of nitriding of the steel sheet can be estimated from the flow rate of $NH_3$ in the nitriding furnace.

Figure 4:
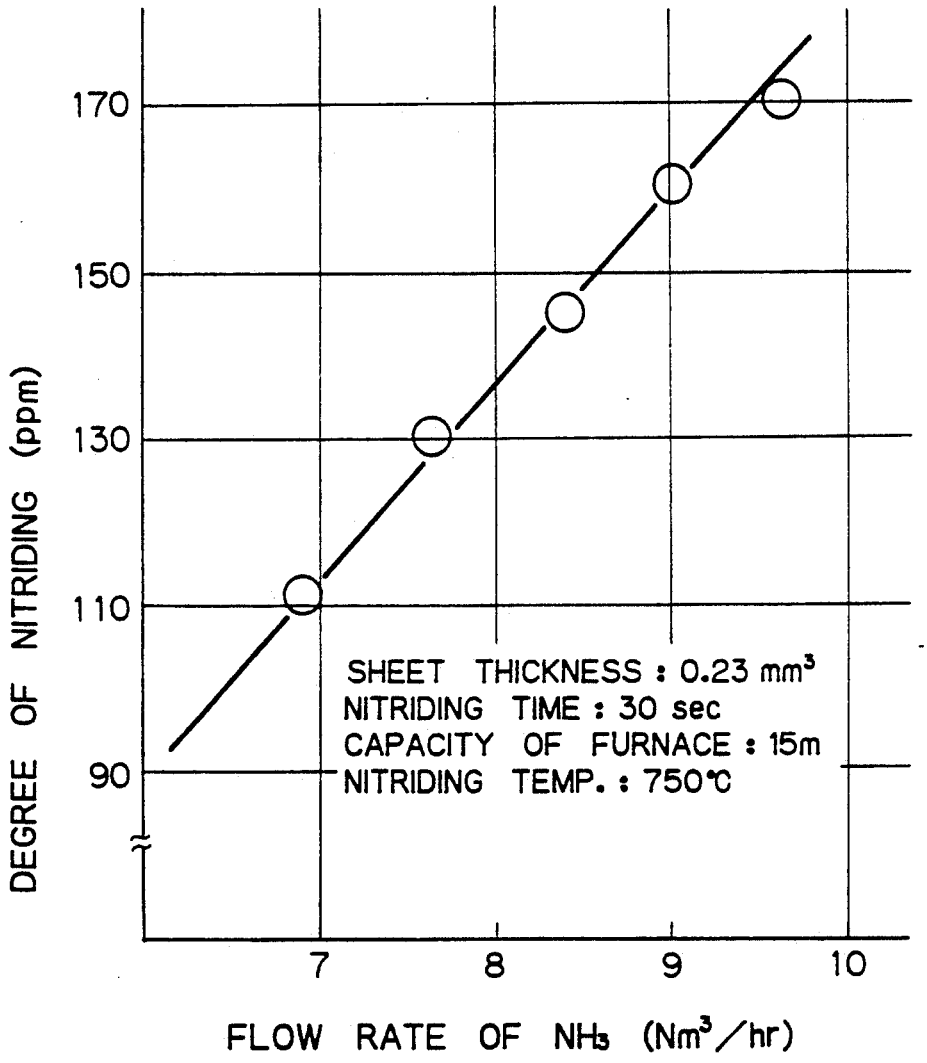
FIG. 4 is a graph showing the relationship between the flow rate of $NH_3$ and the degree of nitriding.
Figure 5:
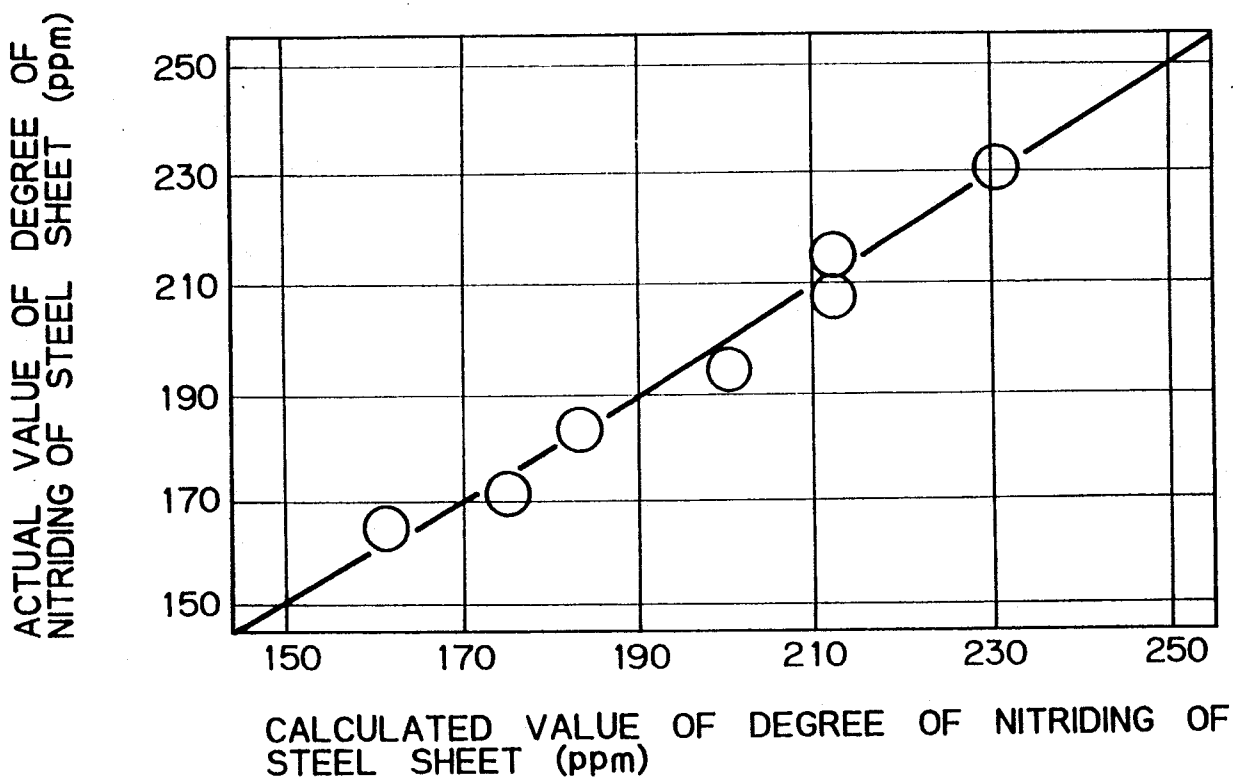
FIG. 5 is a graph showing the relationship between the calculated degree of nitriding of a steel sheet and the actual degree of nitriding of a steel sheet.

FIG. 4 is a graph showing the relationship between the flow rate of $NH_3$ ($Nm^3/hr$) and the degree of nitriding (that is, degree of nitriding = amount of nitrogen in the steel sheet − amount of nitrogen in product steel sheet). The degree of nitriding is determined by determining the flow rate of $NH_3$. That is, the degree of nitriding of the steel sheet is determined by the following equation: degree of nitriding of the steel sheet = (nitriding rate) × (nitriding time) × (flow rate of $NH_3$)/(sheet thickness). As is apparent from FIG. 5, which is a graph showing the relationship between the calculated degree of nitriding of the steel sheet and the actual degree of nitriding of the steel sheet, the calculated degree of nitriding of the steel sheet is in agreement with the actual degree of nitriding of the steel sheet.

The average diameter of the primary recrystallized grain is determined from the amount of nitrogen in the steel sheet determined by the above-described method and the iron loss value after decarburization annealing by using the equation (1), the iron loss value of the final product sheet derived from the average grain-diameter is determined from the relationship (FIG. 3) between the average grain-diameter and the iron loss value of the product sheet after finish annealing, and the heating temperature in the decarburization annealing is adjusted based on FIG. 1 so that the average grain-diameter becomes optimal to obtain a desired iron loss value of the final product sheet, e.g., 0.82 w/kg or less.

Then, the steel sheet is coated with an annealing separator composed mainly of MgO, and subjected to finish annealing at a temperature in the range of from 1150° to 1280° C. for 15 to 30 hr.

The present invention will now be described in more detail with reference to the following Examples that by no means limit the scope of the invention.

EXAMPLES

Example 1

A slab comprising ingredients specified in Table 1 was heated under conditions specified in Table 2 and hot-rolled to a thickness of 1.6 mm. The hot-rolled sheet was cold-rolled to a thickness of 0.23 mm. Then, the cold-rolled steel sheet was decarburized by holding the sheet in an atmosphere having a dew point of 60° C., a $H_2$ content of 75% and a $N_2$ content of 25% at a temperature of 830° C. for 155 sec.

Subsequently, the decarburized steel sheet was nitrided by holding the sheet at 770° C. for 30 sec in an atmosphere having a Hz content of 75% and a $N_2$ content of 25% and a dew point of −20° C. and containing a very small amount of $NH_3$ introduced thereinto. The amount of nitrogen of the steel sheet and the iron loss value after decarburization annealing were measured to determine the average grain-diameter, and annealing was performed at a steel sheet temperature that varied according to the relationship (FIG. 3) between the average grain-diameter and the iron loss of the product sheet after finish annealing. Then, the steel sheet was coated with an annealing separator composed mainly of MgO and subjected to finish annealing at 1200° C. for 20 hr. The magnetic properties and the film property of the resultant oriented electrical steel sheet are given in Table 3.

TABLE 1

| | Symbol | Ingredient of steel (%) | | | | | | |
|---|---|---|---|---|---|---|---|---|
| | | C | Si | Mn | S | Al | N | Sn |
| | 1 | 0.055 | 3.21 | 0.0132 | 0.007 | 0.0278 | 0.0071 | 0.021 |
| | 2 | 0.063 | 3.28 | 0.0141 | 0.008 | 0.0265 | 0.0076 | 0.023 |
| ○ | 3 | 0.057 | 3.23 | 0.0137 | 0.006 | 0.0270 | 0.0074 | 0.019 |
| ○ | 4 | 0.053 | 3.20 | 0.0140 | 0.007 | 0.0274 | 0.0072 | 0.027 |
| ○ | 5 | 0.057 | 3.26 | 0.0135 | 0.008 | 0.0281 | 0.0071 | 0.022 |
| ○ | 6 | 0.061 | 3.22 | 0.0139 | 0.006 | 0.0264 | 0.0075 | 0.017 |
| ○ | 7 | 0.061 | 3.28 | 0.0133 | 0.007 | 0.0273 | 0.0073 | 0.025 |

Note) ○ represents the present invention.

TABLE 2

| | Symbol | Slab heating temp. (°C.) | Amount of nitrogen of steel sheet (ppm) | Iron loss at the time of decarburization annealing $W_{13/50}$ (w/kg) | Estimated average grain-diameter of primary recrystallized grain (μm) | Measured average grain-diameter of primary recrystallized grain (μm) |
|---|---|---|---|---|---|---|
| | 1 | 1180 | 170 | 2.613 | 27.2 | 27.5 |
| | 2 | 1210 | 190 | 3.698 | 18.5 | 18.7 |
| ○ | 3 | 1190 | 183 | 3.101 | 23.5 | 23.4 |
| ○ | 4 | 1150 | 195 | 3.094 | 24.2 | 24.0 |
| ○ | 5 | 1220 | 188 | 2.932 | 25.3 | 25.5 |
| ○ | 6 | 1150 | 179 | 3.033 | 23.9 | 23.7 |
| ○ | 7 | 1170 | 201 | 3.081 | 24.6 | 24.5 |

Note) ○ represents the present invention

TABLE 3

| | Symbol | Magnetic flux density $B_8$ (T) | Iron loss product sheet $W_{17/50}$ (w/kg) | Property of film (defect of film) |
|---|---|---|---|---|
| | 1 | 1.91 | 0.98 | good |
| | 2 | 1.91 | 0.93 | good |
| ○ | 3 | 1.92 | 0.80 | good |
| ○ | 4 | 1.93 | 0.79 | good |
| ○ | 5 | 1.92 | 0.80 | good |
| ○ | 6 | 1.93 | 0.79 | good |
| ○ | 7 | 1.93 | 0.79 | good |

Note) *: ○ represents the present invention.

In the tables, symbols 1 and 2 represent examples wherein the process of the present invention has not been used. In these examples, the estimated average grain-diameter of the primary recrystallized grain based on the amount of nitrogen of the steel sheet and the iron loss value at the time of decarburization annealing deviates significantly from the optimal average grain-diameter range, so that the iron loss value of the final product is large. Symbols 3 to 7 represent examples wherein the treatment according to the present invention has been used. For example, in the symbol 3, the average diameter of the primary recrystallized grain was calculated from the iron loss value, that is, 3.25 w/kg measured after the decarburization annealing and the amount of nitrogen of the steel sheet, that is, 183 ppm, and found to be 22 μm (see FIG. 2), and next decarburization annealing was performed at a decarburization annealing temperature of 833° C. determined from the line shown by the symbol © in FIG. 1 based on the AlR value, that is 127 ppm according to the amount of nitrogen of the steel sheet, i.e., $$AlR = Al - \frac{27}{14} N = 270 - \frac{27}{14} \times 74,$$

and the estimated average diameter of the primary recrystallized grain, that is, 23.5 μm. As a result, the iron loss value, $W_{13/50}$, at the time of decarburization annealing and the measured average diameter of the primary recrystallized grain were 3.101 w/kg and 23.4 μm, respectively, and the iron loss value, $W_{17/50}$, of the final product sheet was 0.80 w/kg, that is, a desired iron loss value (i.e., 0.82 w/kg or less) could be obtained.

Thus, according to the present invention, an oriented electrical steel sheet having excellent magnetic properties can be produced by determining the average diameter of a primary recrystallized grain using an online measurement and regulating this average grain-diameter so as to fall within a proper range.

We claim:

1. A process for producing an oriented electrical steel sheet having excellent magnetic properties, comprising the steps of:

heating a slab for electrical steel sheet to a temperature of 1280° C. or below;

hot-rolling the heated slab to provide a hot-rolled sheet;

subjecting the hot-rolled sheet to cold rolling once or at least twice with intermediate annealing being performed between rollings;

placing the cold-rolled sheet in a decarburization annealing furnace and subjecting the cold-rolled sheet to decarburization annealing and a nitriding treatment to form an inhibitor in said steel sheet;

obtaining in advance the following relationships:

(A) the relationship between the average diameter of the primary recrystallized grain formed by the decarburization annealing and the decarburization annealing temperature;

(B) the relationship between said average diameter of the primary recrystallized grain and the iron loss value of the final product sheet;

(C) the relationship between the amount of nitrogen of the steel sheet and the average diameter of the primary recrystallized grain and the iron loss value; and obtaining the range of the average diameter of the primary recrystallized grain from which the desired iron loss value of the final product sheet can be obtained from the above relationship (B);

measuring the amount of nitrogen in and the iron loss value of the steel sheet, on which the decarburization annealing and the continuous nitriding treatment have been carried out, and obtaining the average diameter of the primary recrystallized grain from the above relationship (C);

regulating the heating temperature in the decarburization annealing from the relationship (A) in order to obtain the average diameter of the primary recrystallized grain in the range of the average diameter of the primary recrystallized grain obtained from the relationship (B); and coating the steel sheet subjected to the decarburization annealing with an annealing separator composed mainly of MgO and then subjecting the coated sheet to finish annealing.

2. The process according to claim 1, wherein after the hot rolling, the hot-rolled steel sheet is annealed.

3. The process according to claim 1, wherein part of the steel sheet withdrawn from the nitriding furnace is sampled and the amount of nitrogen of the steel sheet is directly measure.

4. The process according to claim 1, wherein the iron loss is measured by providing primary and secondary coils for an iron loss measurement between an annealing furnace and an annealing separator coating device and passing the steel sheet through the primary and secondary coils to measure the iron loss.

5. The process according to claim 1, wherein the iron loss is measured by providing primary and secondary coils for an iron loss measurement between an annealing separator coating device and a coiler and passing the steel sheet through the primary and secondary coils to measure the iron loss.

6. The process according to claim 1, wherein the degree of nitriding of the steel sheet is estimated from the flow rate of ammonia introduced into the atmosphere of the nitriding furnace.

* * * * *